United States Patent [19]

Junek et al.

[11] Patent Number: 4,499,718

[45] Date of Patent: Feb. 19, 1985

[54] APPARATUS FOR SEPARATING IMPURITIES FROM OPEN-END SPINNING UNITS

[75] Inventors: Jan Junek; Josef Skarka; Frantisek Jaros; Frantisek Hortlik; Kveta Hacova, all of Usti n/Orl.; Vaclav Vobornik, Letohrad; Vladimi Ohlidal; Ludmila Lihtarova, both of Usti n/Orl., all of Czechoslovakia

[73] Assignee: Vyzkumny ustav bavlnarsky, Usti n/Orl., Czechoslovakia

[21] Appl. No.: 509,244

[22] Filed: Jun. 29, 1983

[30] Foreign Application Priority Data

Jul. 12, 1982 [CS] Czechoslovakia ..... 5306-82

[51] Int. Cl.[3] ..... D01H 7/888; D01H 7/892

[52] U.S. Cl. ..... 57/301; 57/304; 57/411

[58] Field of Search ..... 57/301, 302, 304, 408, 57/411

[56] References Cited

U.S. PATENT DOCUMENTS

| | | | |
|---|---|---|---|
| 3,892,063 | 7/1975 | Doudlebsky et al. | 57/301 |
| 4,009,562 | 3/1977 | Stalder | 57/301 |
| 4,142,356 | 3/1979 | Husges et al. | 57/304 X |
| 4,204,393 | 5/1980 | Miyazaki et al. | 57/304 X |
| 4,314,440 | 2/1982 | Onoue et al. | 57/301 |

*Primary Examiner*—John Petrakes

[57] ABSTRACT

Fiber separating device of an open-end spinning unit wherein the wall facing the fiber separating cylinder is provided with an impurity separating duct and with one or more air supply apertures. The air supply apertures are oriented symmetrically with respect to a plane substantially passing through the axis of the impurity separating duct and perpendicular to the axis of the fiber separating cylinder, the axes of said apertures including the same angles with the opposite walls of the impurity separating duct. The fiber separating device of the invention solves the problem of withdrawing impurities from fibrous materials supplied to the fiber separating device of open-end spinning unit, while reducing losses of the fibrous material.

8 Claims, 9 Drawing Figures

APPARATUS FOR SEPARATING IMPURITIES FROM OPEN-END SPINNING UNITS

This invention relates to an apparatus for separating impurities from open-end spinning units. Such apparatus comprises a fiber separating cylinder disposed in a recess of a housing, there being provided in the cylindrical surface of said recess a cleaning aperture merging into an impurity separating duct through which air flows to the fiber separating cylinder and to the spinning rotor of the unit in a direction which is opposite to that in which the impurities fly off. The impurity separating duct is followed by an impurity withdrawing duct communicating with a sub-atmospheric pressure source; an atmospheric air supply aperture is provided at the outlet of said impurity separating duct and at the inlet of said impurity withdrawing duct.

As is known, impurities contained in fibrous sliver supplied to the fiber separating devices of open-end spinning units are withdrawn either during the fiber separating process or during the transport of fibers to the so-called fiber stripping zone. In the impurity separating process, impurities are separated from fibers and ejected into a cleaning aperture provided in the inner cylindrical wall of the fiber separating housing. Such cleaning aperture is immediately followed by an impurity separating duct which extends at an acute angle relative to an impurity withdrawing duct and finally opens thereinto. The withdrawing duct communicates directly at one of its ends with a central impurity withdrawing conduit arranged in the spinning machine frame, and communicates at its other end with the ambient atmosphere. This other end portion forms, from its inlet up to the opening into said impurity separating duct, the so-called air supply duct. The above-described arrangement is disclosed in Swiss patent No. 593,355 and is designed for leading impurities from said cleaning aperture through said separating duct into an air stream which flows through an impurity withdrawing duct toward the central impurity withdrawing conduit.

However, a part of this air stream supplied through said air supply duct flows into the impurity separating duct, and particularly flows across the flow of withdrawn impurities and fibers, and enters the fiber supply duct leading to the spinning rotor through the cleaning aperture. However, this part of the air stream necessary for conveying fibers into the spinning rotor also assumes a function of returning or directing the fibers toward the clothing of the separating cylinder; this means fibers which, due to various influences, have been carried to far away from said toothed clothing, enter the cleaning aperture, and tend to fly away into the impurity withdrawing duct. A critical region, in this case, is the opening of the separating duct into the withdrawing duct, which also constitutes the extreme point from which the fibers are still capable of being returned back to the fiber separating cylinder by the effect of the air stream led across from the air supply duct to the cleaning aperture. If the fibers cross this boundary, they are carried away by the air stream into the impurity withdrawing duct. Here the effort to effect impurity separation has an effect which is the exact obvious of the endeavor to prevent the fibers from flying off into the impurity withdrawing duct.

West German published patent application (DE-OS) No. 2,856,058 attempts to optimalize the impurity separation process. In such application there is described apparatus wherein it is asserted that an air stream from the air supply duct to the cleaning aperture which flows perpendicularly to the direction of flying off of impurities in the separating duct is advantageous. However, even this apparatus fails to solve the serious problem to be overcome, particularly because of the fact that the waste to be separated considerably depends upon the amount and velocity of air flowing into the withdrawing duct communicating with the central impurity withdrawing conduit.

The problem of how to adjust the same values of subatmospheric pressure values of air, and consequently the same amounts of air, in all the impurity withdrawing ducts of the individual open-end spinning units along the entire length of the central conduit is very difficult and complicated. Such problem has been solved in the prior art either by various structures of the central conduit, or by variously shaped cross-sections of outlets of the impurity withdrawing ducts into said conduit. However, it has been proved that even after these measures, the sub-atmospheric air pressures vary in the spinning units. Apart from this, the problem is complicated by the fact the waste amounts to be separated from the individual spinning units are not alike, so that cleaning effects vary, and in some spinning stations the rotors are supplied with higher waste amounts than in the others.

The process of separating impurities from the fibrous material depends upon the differing aerodynamic characteristics of the impurities and of the fibers. The differences can be characterized, in general, by constants of air resistance of impurities (Cn) and that of fibers (Cv), said constants being given by a ratio of air resistance of impurities or fibers, respectively, to the specific weights thereof. The fundamental principle of impurity separation is based upon the relationship Cn is less than Cv ($Cn < Cv$).

For the separation of impurities from fibers there is used an air stream which may be substantially perpendicular to the direction of fiber flow (cf. DE-OS No. 2,856,058), or an air stream which flows substantially in counter-direction to the fiber and impurity flow, said stream and said flow including an angle of more than 90 degrees (cf. CH-PS No. 593,355). A counter-direction air stream is more effective for the separation of impurities from fibers.

However, according to British patent specification No. 1,419,862, it is also possible to employ a combination of the two air stream types, wherein the oblique air stream can be controlled so as accurately to adjust the velocity of the counter-direction air stream.

With all types of apparatus of the prior art, wherein impurities are ejected by means of air through a withdrawing duct to a central impurity withdrawing conduit, air is supplied in the direction of impurity withdrawal. With such apparatus, the marginal planes of the ejected divergent impurity and fiber flow are variously spaced apart from the initial edge of the cleaning aperture into the withdrawing duct, so that it is not possible to attain the maximum cleaning effect within the entire width of divergent flow if the impurities have a minimum fiber content. This problem will be hereinafter referred to in more detail.

In accordance with the apparatus disclosed in British patent specification No. 1,419,862 discussed above, air for separating impurities from fibers and for withdrawing them is supplied from above toward the bottom of the separating duct and the withdrawing duct. It is admitted that such an arrangement can eliminate, to some extent, the disadvantages as hereinabove set forth, but it causes a deflection of the continuing fiber flow in the direction toward the bottom of the impurity separating duct and toward the lower edge of the fiber separating cylinder. In this way, fibers are thrown against the walls of the duct and form agglomerates which negatively influence the final yarn quality and the rate of thread breakage.

The apparatus of the present invention has among its objects the solution of the problem, in open-end spinning units having a cleaning aperture and an impurity separating duct followed by an impurity withdrawing duct and an air supply aperture, of impurity withdrawal while reducing fiber losses to a minimum, and to provide such an apparatus for separating impurities from open-end spinning units which exhibit a minimum sensitivity of the volume of through-flow air for impurity withdrawal, as well as to variations in the speed of rotation of the fiber separating cylinder and the spinning rotor, while simultaneously reducing the rate of air consumption to a minimum.

The essential advantage of the apparatus according to the invention resides in its maximum cleaning effectivity while maintaining a desirable impurity composition, the cleaning process depending only to a small extent upon the pneumatic parameters of the spinning unit, that is the through-flow volume of air necessary for impurity withdrawal as well as air to be sucked, via the impurity separating duct, into the spinning rotor and to separate the impurities from the fibers.

The invention will be more readily understood from the following detailed description of some preferred embodiments thereof when read with reference to the accompanying schematic drawings in which.

Figure 3:
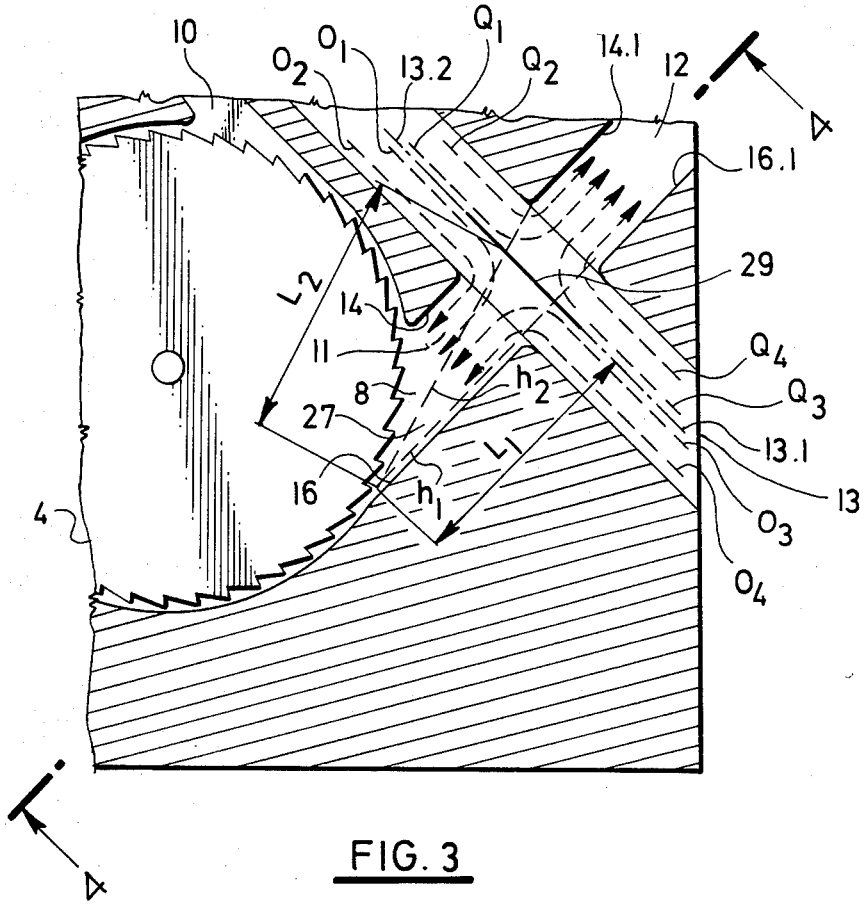
FIG. 3 is a view similar to FIGS. 1 and 2 illustrating a first embodiment of apparatus in accordance with the invention, the figure particularly showing the communication between the separating duct and the straight withdrawing duct, there being an air supply aperture provided therein in the form of an annular gap.

FIGS. *6a* and *6b* illustrate a third embodiment of apparatus in accordance with the invention, FIG. *6a* being a fragmentary view taken in a manner similar to that of FIG. 3, and FIG. *6b* being a view in elevation taken from the point of view of line *6b*—*6b* in FIG. *6a;*

Figure 7:
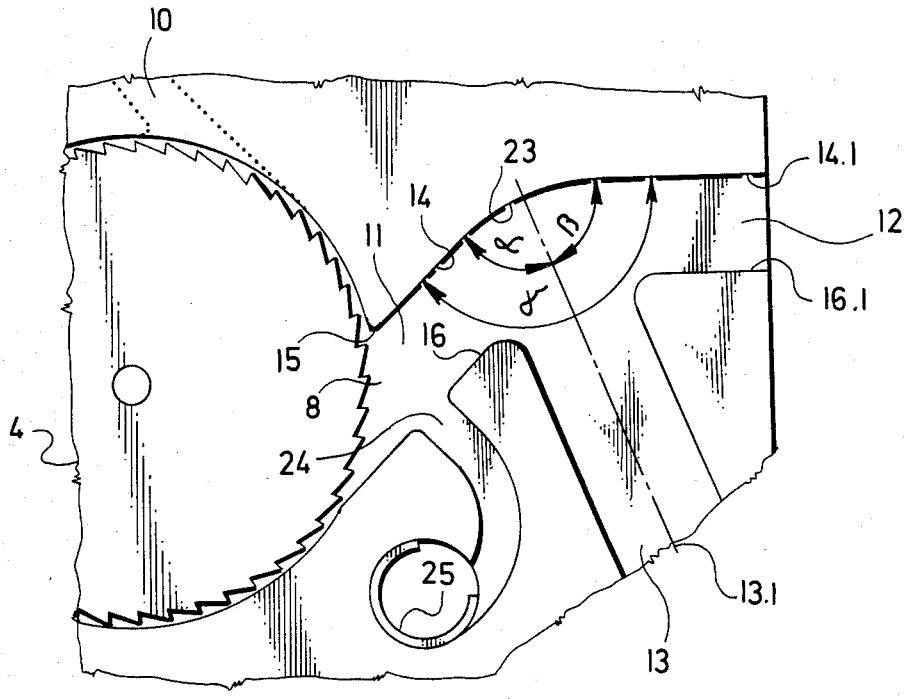
Figure 8:
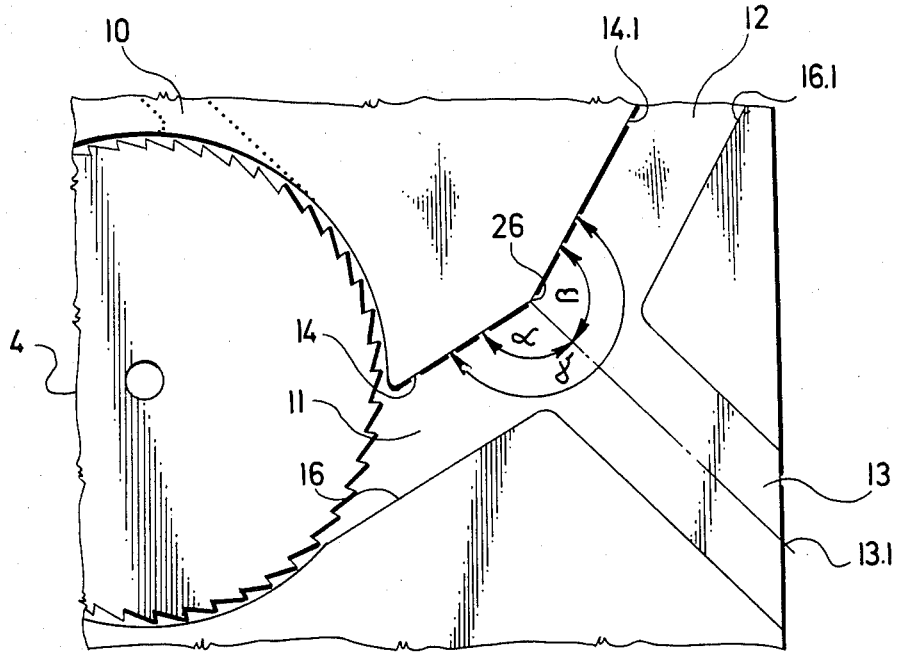

FIG. 7 is a view similar to FIG. 3 but showing a fourth embodiment of apparatus in accordance with the invention, such embodiment employing a curvilinear communication between the separating duct and the withdrawing duct; and FIG. 8 is a view similar to FIG. 3 illustrating a fifth embodiment of apparatus in accordance with the invention, in such embodiment the separating duct and the withdrawing duct are disposed at an angle of more than 180 degrees with respect to each other.

Figure 1:
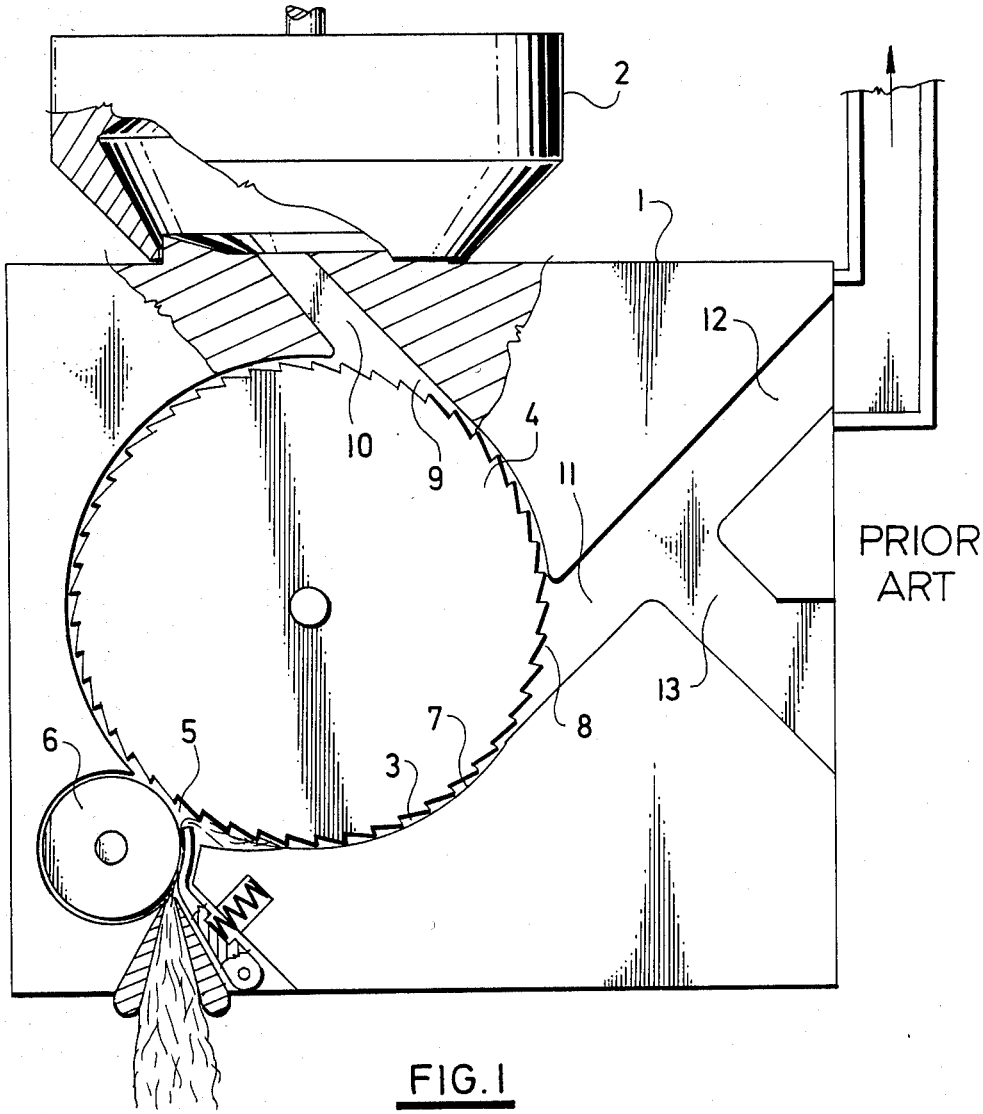
FIG. 1 is a total top view of one prior art open-end spinning unit, such figure showing a fiber separating housing with the separating cylinder, the cover of the housing have been removed for clarity of illustration.

Turning first to FIG. 1, which shows one embodiment of prior art open-end spinning unit, such unit has a fiber separating housing 1 and a spinning housing (not shown) in which a spinning rotor 2 is accomodated. In the fiber separating housing 1 there is provided a cylindrical recess 3 which receives a fiber separating cylinder 4, the lower part of said recess 3 communicating with a recess 5 which accomodates a known fiber feeding device 6. Device 6 comprises a feed roller and a feed shoe. In the peripheral cylindrical surface 7 of the cylindrical recess 3 there is provided a cleaning aperture 8 which is followed, in the direction of rotation of the fiber separating cylinder 4, by the inlet 9 of a fiber supply duct 10 opening into the spinning rotor 2. The cleaning aperture 8 can be provided either in close proximity to said inlet 9, which means at the beginning of the so-called fiber stripping zone, or somewhere on said cylindrical surface 7 between said zone and the fiber feeding device 6. The cleaning aperture 8 opens into an impurity separating duct 11 which continues as an impurity withdrawing duct 12.

Figure 2:
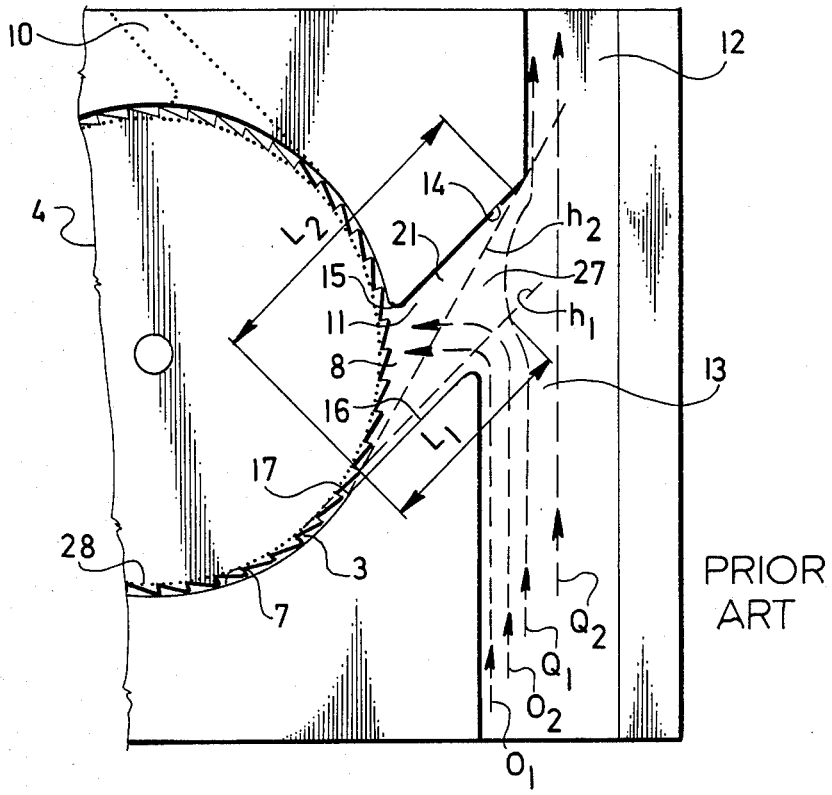
FIG. 2 is a similar top view of another prior art open-end spinning unit, the figure showing the communication between an impurity separating duct and an impurity withdrawing duct.

Turning now to FIG. 2, there is there shown an embodiment of open-end spinning apparatus corresponding to that disclosed in Swiss patent No. 593,355. The impurity withdrawing duct 12 opens into a central impurity withdrawing conduit (not shown) which is arranged in the machine frame. The duct 12 further communicates with an air supply aperture 13 for supplying air both into said duct 12 and into the impurity separating duct 11. Air is led through said duct 11 to the fiber separating cylinder 4 and passes through the fiber stripping zone where it takes on fibers separated by the cylinder 4 and conveys them through the fiber supply duct 10 to the spinning rotor 2. Thus the air flow which carries the fibers along back to the separating cylinder 4 but which simultaneously has to allow impurities to flow away from the withdrawing duct 12, is led through said impurity separating duct 11. Impurity separating duct 11 is defined, on the one hand, by an impurity rebounding wall 14 commencing at the end edge 15 of the cleaning aperture 8, and, on the other hand, by a bottom wall 21 and a top wall (not shown) spaced therefrom and parallel thereto, which latter can be constituted by a cover (not shown) for the housing.

The air flow indicated by flow arrows $O_1$, $O_2$ and $Q_1$, $Q_2$ is led from the air supply aperture 13 straight into the impurity withdrawing duct 12. As hereinabove set forth, and as amplified hereinbelow, such a known embodiment has a plurality of disadvantages.

The spaced section wherein the fibers, due to the air flow, are separated from impurities in the separating duct 11, and the calculation of which is referred to in the professional literature, depends upon the following parameters:

1. Resistance constant of impurities and that of the fibers, which constants are given by the material used.

2. The initial speed of fibers and impurities when entering the cleaning aperture, said speed being given by the location of the aperture and by the speed of rotation of the fiber separating cylinder.

3. The speed and direction of air flow which is to separate impurities from the fibers. This speed is determined by the through-flow air volume sucked in by the spinning rotor as well as by the shape and cross-section of the impurity separating duct. It is also the flow characteristics and the unwanted whirl formation in the separating duct that count.

To obtain the maximum cleaning effect, it is possible to add to the above constant parameters only one distance section wherein the impurities are separated from the fibers. In the design of the impurity separating duct 11, the fact is to be considered that the ejected flow 27 of impurities and fibers is divergent. As is apparent in FIG. 2, a predominant part of impurities and fibers moves in a set of planes commencing in the intersection edge along the initial edge 17 of the cleaning aperture 8, the front marginal plane $h_2$ being constituted by a plane tangential to the cylindrical surface 7 of the cavity 3 accommodating cylinder 4, while the rear plane $h_1$ is tangential to the root circle 28 of the fiber separating cylinder 4. In this embodiment, the zone $L_2$ on the front marginal plane $h_2$ in the impurity separating duct 11 where the separation of impurities from fibers occurs, is longer at the front part of the divergent flow 27 than the zone $L_1$ on the rear plane $h_1$ of said flow 27.

Thus it is evident that when locating the maximum cleaning effect within the zone $L_2$ defined by the initial edge 17 of the cleaning aperture 8 and the point in which the plane $h_2$ of the divergent flow 27 enters the impurity withdrawing duct 12 or where the pane $h_2$ intersects the first air stream line $Q_1$ passing through the air supply aperture 13 into the withdrawing duct 12, fibers tend to fly off to waste from the continuing portion of said flow 27 adjacent the rear plane $h_1$, since the fiber path meets the air stream line $Q_1$ in the impurity withdrawing duct 12. When, to the contrary, the maximum cleaning effect is located within the zone $L_1$ defined by the initial edge 17 of the cleaning aperture 8 and the point in which the plane $h_1$ intersects the air stream line $Q_1$, the relatively slowly moving impurities adjacent the front plane $h_2$ of the flow 27 will return back to the separating cylinder 4 whereby the cleaning effect is impaired. Apart from this, such arrangements considerably depend on the through-flow volume of air to withdraw the impurities, since in the case of a larger through-flow volume the amount of fibers in waste rises, due to a displacement of the stream line $Q_1$ in the direction to the impurity separating duct 11.

The afore-mentioned disadvantages of the prior art, discussed above in connection with FIGS. 1 and 2, are eliminated by the apparatus of the invention as shown in various embodiments thereof in FIGS. 3–8, inclusive. Turning first to FIG. 3, which shows a first illustrative embodiment of the apparatus of the invention, such figure shows the air supply aperture 13 in the form of an annular gap about the entire periphery of the impurity separating duct 11 and the impurity withdrawing duct 12; in an unillustrated alternative of such construction, the aperture 13 can be made in the form of a gap between the housing 1 and the continuing withdrawing duct 12.

Figure 4:
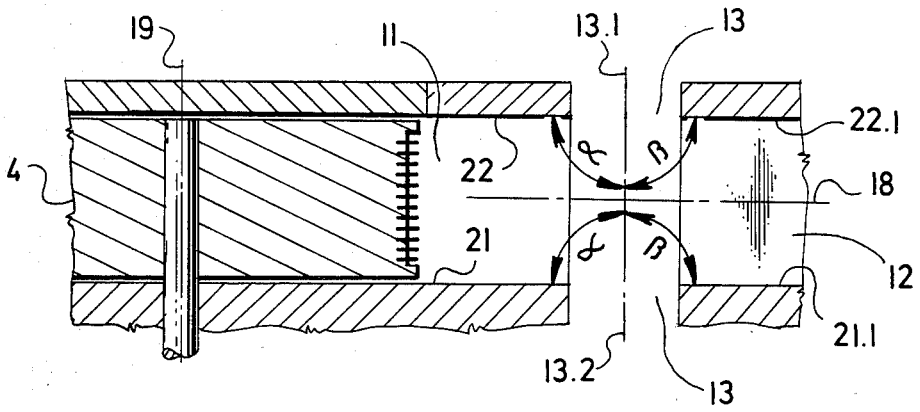
FIG. 4 is a sectional view of such first embodiment of apparatus in accordance with the invention, the section being taken along the line 4—4 in FIG. 3.

To obtain more uniform or stable air flow conditions to provide for the maximum cleaning effect in case of a minimum fiber in the impurities across the entire flow of impurities to be ejected, the air supply apertures 13 are made symmetrical with respect to a plane 18 which passes through the axis of the impurity separating duct 11 and is perpendicular to the axis 19 of the fiber separating cylinder 4, as apparent in FIG. 4. The axes 13.1, 13.2 of said apertures 13 include the same angles alpha and beta with the walls 14, 16, 21, 22 of the impurity separating duct 11 and the opposite walls 14.1, 16.1, 21.1, 22.1 of the impurity withdrawing duct 12. The walls 16.1, 14.1, 21.1, 22.1 of the duct 12 merge, immediately downstream of the air supply aperture 13, into the respective walls 14, 16, 21, 22 of the impurity separating duct 11 so that they are indicated by the same reference numerals and distinguish from the latter in the various ones of FIGS. 3–8, incl., by indices only.

Because the axes 13.1 and 13.2 of the air supply apertures 13 include the same angles alpha and beta with the walls 14, 16, 21, 22 of the impurity separating duct 11 and the opposite walls 14.1, 16.1, 21.1, 22.1 of the impurity withdrawing duct 12, there is achieved the result that the air stream flowing in counter-direction to the impurity and fiber fly off, and as indicated by stream lines $O_{1-4}$ is divided from the impurity withdrawing air stream. Such withdrawing air stream is indicated by the stream lines $Q_{1-4}$ by a narrow boundary 29 which is defined by the divergence of the air stream lines $O_{1-4}$ and $Q_{1-4}$ which cross the divergent impurity flow 27. By the boundary 29 there is to be understood a zone between the separating duct 11 and the withdrawing duct 12 where the air in the impurity flow direction has a zero speed. Since the position of the boundary 29 varies only negligibly together with a varying through-flow volume of air for impurity withdrawal, and with the through-flow volume of air sucked through the separating duct 11 into the spinning rotor 2, the apparatus is not sensitive to such variations, and substantially a uniform waste amount is ejected from each of the spinning units into the central impurity withdrawing conduit extending along the entire machine. Since the boundary 29 crosses the divergent flow 27, the zones $L_1$ and $L_2$ as hereinabove referred to in reference to FIG. 2 have the same length in the apparatus of FIGS. 3 and 4. In this way a uniform cleaning effect within the entire width of the impurity divergent flow 27 is achieved.

The air supply apertures 13 are made symmetrical with respect to the plane 18 which passes through the axis of the impurity separating duct 11 and is perpendicular to the axis 19 of the fiber separating cylinder 4. Such an arrangement ensures an even flow along said plane 18 in the entire height of the separating duct 11, as well as that of the withdrawing duct 12. In this way, the fiber flow which returns to the bottom wall 21 or top wall 22 of the separating duct 11, as well as to the marginal portions of the fiber separating cylinder 4, is prevented from being deflected. Apart from this, the uniformity of fiber flow and consequently the quality of final yarn product is improved, as the formation of fiber deposit in the space between the bottom of the cylindrical cavity 3 and the separating cylinder 4 is prevented. To prevent the formation of air eddies or whirls, it is preferable that the edges between the air supply aperture 13 and the separating duct 11, or the withdrawing duct 12, be rounded off.

The length of the impurity separating duct 11 is defined as the distance between the initial edge 17 of the cleaning aperture 8 and the edge of the air supply aperture 13, and is determined by the velocity of the impurity and fiber divergent flow 27 being ejected.

As can be seen in FIGS. 3 and 4, the air supply aperture 13 can be embodied as an annular gap about the entire periphery of the separating duct 11 and the withdrawing duct 12. Such an aperture has an infinite set of axes 13.1, 13.2 which all pass through the axis of the impurity separating duct 11. In this embodiment there is provided a stable stream which is symmetrical with respect to the axis of the impurity separating duct 11, whereby the flow of returning fibers is positively influenced.

Figure 5:
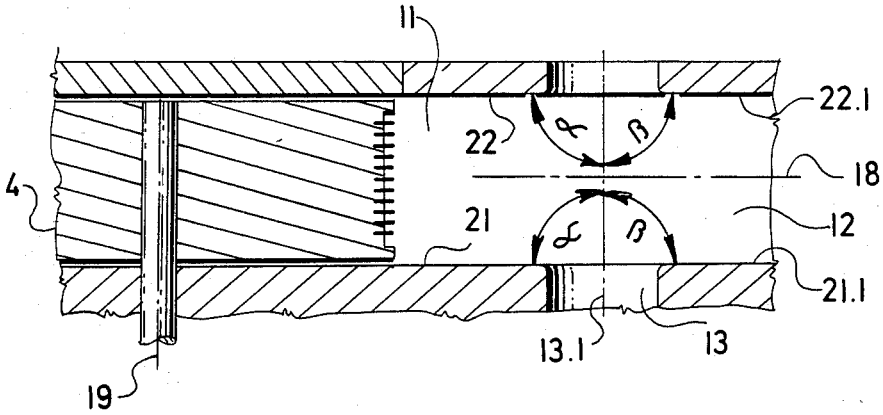
FIG. 5 is a view similar to FIG. 4 of a second illustrative embodiment of apparatus in accordance with the invention.

A second embodiment of apparatus according to the invention is shown in FIG. 5, wherein the air supply aperture 13 is provided on the transition between the two ducts 11 and 12, on the one hand, in the bottom wall 21, 21.1, and on the other hand, in the top wall 22, 22.1, opposite each other and in the direction of the axis 19 of the fiber separating cylinder 4.

In this embodiment, to cause the air to flow in the separating duct 11 symmetrically relative to the plane 18, it is also possible to provide two opposite air supply apertures 13 in the top wall 22 and the bottom wall 21 of the impurity separating duct 11, respectively, said apertures being oriented in the direction of the axis 19 of the fiber separating cylinder 4, as is apparent in FIG. 5.

Figure 6B:
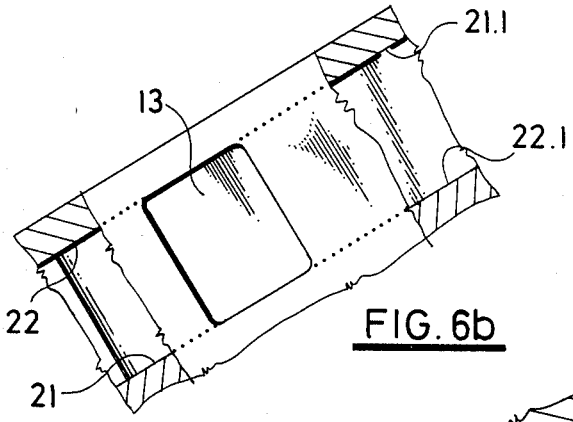
Figure 6A:
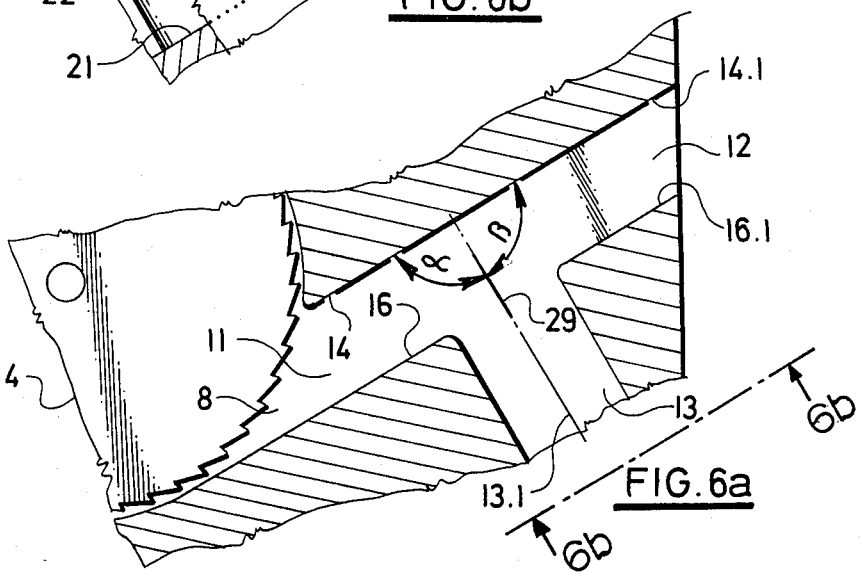

FIGS. 6*a* and 6*b* show a third preferred embodiment of the apparatus of the invention; in such embodiment the air supply aperture 13 is provided in the guide wall 16, 16.1 of the impurity separating duct 11, and the impurity withdrawing duct 12, respectively, and is oriented in the direction opposite the impurity rebounding walls 14, 14.1 of said ducts 11 and 12. In this embodiment, the rebounding wall 14 of the duct 11 lies in the same plane as the continuing rebounding wall 14.1 of the impurity withdrawing duct 12 so that said aperture 13 points perpendicularly toward said rebounding walls 14, 14.1 on the transition between said ducts 11 and 12.

The embodiment of FIGS. 6*a* and 6*b* is advantageous as to the manufacture thereof. The air supply aperture is provided in the guide wall 16 of the impurity separating duct 11 opposite the impurity rebounding walls 14. It is true that in this embodiment, the boundary 29 adjacent the rebounding wall 14 is made broader, due to the arising of small air whirls, but from the viewpoint of simplicity of manufacture, it is quite advantageous. The simplest embodiment is in the case in which the guide wall 16 of the impurity separating duct 11 and the continuing wall 16.1 of the impurity withdrawing duct 12 lie in one and the same plane.

FIG. 7 of the drawings show a fourth preferred embodiment of the apparatus of the invention. In such embodiment the impurity withdrawing duct 12 forms with the impurity separating duct 11 and angle gamma which is smaller than 180 degrees, which means, that the rebounding wall 14 of the duct 11 includes with the rebounding wall 14.1 of the duct 12 an angle gamma of less than 180 degrees. The two rebounding walls 14, 14.1 merge into each other in the form of a continuous rounding 23. In the guide wall 16 of the separating duct 11 there is also provided an auxiliary aperture 24 for supplying air perpendicularly to the impurity flow being ejected into said duct 11, said air flow being led to the end edge 15 of the cleaning aperture 8. This auxiliary aperture 24 is provided with a regulating member 25 for adjusting a desirable air flow. Thus the air supply aperture 13 is made symmetrical with respect to the plane 18 and is directed toward the rounding 23 which connects the impurity rebounding walls 14, 14.1 of the two ducts 11 and 12, respectively.

The embodiment of FIG. 7 is preferred in those cases wherein it is necessary to withdraw impurities from the side, or the bottom of the spinning unit. The rebounding wall 14 of the impurity separating duct 11 includes with the rebounding wall 14.1 of the impurity withdrawing duct 12 an angle gamma of less than 180 degrees and merges into the latter in the form of the rounded edge 23. From the viewpoint of satisfactory operation, this angle gamma should not be less than 90 degrees. In the guide wall 16, an auxiliary aperture 24 can be provided for supplying an auxiliary air stream oriented toward the end edge 15 and perpendicularly to the ejected flow 27 of impurities and fibers. It is particularly preferable to provide said auxiliary aperture 24 with an air regulating member 25. By regulating the auxiliary air stream which is sucked, via cleaning aperture 8, through the fiber supply duct 10 into the spinning rotor 2, it is made possible also to vary the velocity of the air stream sucked by the air supply aperture 13 through the impurity separating duct 11 and also into the spinning rotor 2. In this way it is possible to provide for the maximum cleaning effect, even in case of any change of the speed of rotation of the separating cylinder, in case of using another type of material to be processed, or in the case of the value of sub-atmospheric pressure in the spinning rotor 2.

Finally, FIG. 8 shows a fifth preferred embodiment of the apparatus in accordance with the invention. In such embodiment, the impurity withdrawing duct 12 merges into the impurity separating duct 11 at an angle gamma of more than 180 degrees, the air supply aperture 13 being directed in the guide wall 16 symmetrically toward the edge 26 connecting the rebounding wall 14 of the duct 11, and the continuing rebounding wall 14.1 of the withdrawing duct 12. Preferably, the cross-section of the air supply aperture 13 is larger than that of the impurity separating duct 11, or the impurity withdrawing duct 12.

It can be seen from above that in the embodiment of FIG. 8 the impurities are withdrawn from the top portion of the spinning unit. The rebounding wall 14 of the impurity separating duct 11 merges into the rebounding wall 14.1 of the impurity withdrawing duct 12 over a connecting edge 26 so that they include together an angle gamma of more than 180 degrees. In order that the flowing in the region of its transition from the air supply aperture 13 into the impurity separating duct 11 and the impurity withdrawing duct 12 may not be impaired, it is preferred that the cross-section of said aperture 13 be larger than that of said two ducts, respectively.

The apparatus in accordance with the invention operates as follows:

A sliver of fibrous material is supplied by the feeding device 6 to the fiber separating cylinder 4 which combs individual fibers by its toothed clothing out of the sliver and conveys them to the inlet 9 of the fiber supply duct 10 and further on to the spinning rotor 2. During this process, impurities are simultaneously released from the fibrous material, and led together with the fibers to the cleaning aperture 8. The impurities, due to the higher centrifugal force to which they are exposed, are ejected through the separating duct 11 into the withdrawing duct 12 in counter-direction relative to the flow of air supplied through the aperture 13. In the cleaning aperture 8, the fibers also tend to leave the clothing of the separating cylinder 4 together with impurities. If the fibers are released from the cylinder clothing, they are carried along by an air flow through the separating duct 11 back to the cylinder 4 and further on to the inlet 9 of the fiber supply duct 10. The air supplied through aperture 13 is uniformly distributed into said two ducts 11 and 12, whereby more advantageous and particularly more stable air flow conditions are established in the region of the cleaning aperture 8. Impurities are led away from the withdrawing duct 12 to the central conduit (not shown) through which they are conveyed to a collecting location outside the spinning machine. The advantages of the apparatus of the invention, when compared to the apparatus of the prior art, have been set forth above.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. In an apparatus for separating impurities from an open-end spinning unit having a driven spinning rotor, said apparatus having a housing, a cylindrical recess in the housing, a fiber separating cylinder accommodated in the cylindrical recess of the housing, a cleaning aperture in the cylindrical surface of said recess, said cleaning aperture merging into an impurity separating duct through which air flows to the fiber separating cylinder and to the spinning rotor of the unit in counter-direction relative to the flying-off of the impurities, the impurity separating duct being followed by an impurity withdrawing duct communicating with a sub-atmospheric pressure source, an atmospheric air supply aperture being provided in the outlet of said impurity separating duct and at the inlet of said impurity withdrawing duct, the improvement wherein the apparatus has at least one atmospheric air supply aperture which is symmetrical with respect to a plane passing substantially through the axis of the impurity separating duct and disposed perpendicular to the axis of the fiber separating cylinder, the axis of the atmospheric air aperture forming the same angle with the opposite walls of said impurity separating duct and with the walls of the impurity withdrawing duct.

2. Apparatus as claimed in claim 1, wherein the air supply aperture is formed as an annular gap about the entire periphery between the impurity separating duct and the impurity withdrawing duct.

3. An apparatus as claimed in claim 1, comprising a transition zone interposed between the impurity separating duct and the impurity withdrawing duct, said transition zone having opposed bottom and top walls, and comprising air supply apertures disposed opposite each other in the bottom and top walls of the transition zone, said air supply apertures extending in the direction of the axis of the fiber separating cylinder.

4. An apparatus as claimed in claim 1, comprising an impurity rebounding wall, and wherein the air supply aperture is provided in the guide wall and the wall of the impurity withdrawing duct opposite said impurity rebounding wall.

5. An apparatus as claimed in claim 4, wherein the impurity rebounding wall of the impurity separating duct, and the impurity rebounding wall of the impurity withdrawing duct lie in one and the same plane.

6. An apparatus as claimed in claim 4, wherein the impurity rebounding wall of the impurity separating duct forms with the impurity rebounding wall of the impurity withdrawing duct an inclination angle of less than 180 degrees, said two walls merging into each other via continuous rounding.

7. An apparatus as claimed in claim 4, wherein the impurity rebounding wall of the impurity separating duct forms with the impurity rebounding wall of the impurity withdrawing duct an inclination angle of more than 180 degrees.

8. An apparatus as claimed in claim 1, wherein in the guide wall of the impurity separating duct there is provided an auxiliary aperture for supplying air perpendicularly to the end edge of the cleaning aperture toward the impurity flow entering the impurity separating duct, said auxiliary aperture being provided with a regulating member.

* * * * *